United States Patent [19]

Stockbridge

[11] Patent Number: 4,521,944

[45] Date of Patent: Jun. 11, 1985

[54] DOWEL-ALIGNED MULTIPLE PLATE STUFFER BOX CRIMPER CONSTRUCTION FOR FILTER TOW

[75] Inventor: Bruce W. Stockbridge, Kingsport, Tenn.

[73] Assignee: Eastman Kodak Company, Rochester, N.Y.

[21] Appl. No.: 573,186

[22] Filed: Jan. 23, 1984

[51] Int. Cl.[3] ..... D02G 1/12

[52] U.S. Cl. ..... 28/264; 28/269

[58] Field of Search ..... 28/263, 264, 268, 269

[56] References Cited

U.S. PATENT DOCUMENTS

| | | | |
|---|---|---|---|
| 2,846,729 | 8/1958 | Sonnino | 28/268 |
| 3,241,213 | 3/1966 | Thompson, Jr. et al. | 28/263 |
| 3,373,469 | 3/1968 | Boggs | 28/269 |
| 3,618,183 | 11/1971 | Funk et al. | 28/269 |
| 4,395,804 | 8/1983 | Saxon et al. | 28/264 X |

FOREIGN PATENT DOCUMENTS

| | | | |
|---|---|---|---|
| 2021103 | 11/1970 | Fed. Rep. of Germany | 28/269 |
| 2117725 | 10/1972 | Fed. Rep. of Germany | 28/263 |
| 1057417 | 2/1967 | United Kingdom | 28/263 |
| 1205534 | 9/1970 | United Kingdom | 28/263 |
| 1571521 | 7/1980 | United Kingdom | 28/269 |

*Primary Examiner*—Robert R. Mackey

[57] ABSTRACT

Novel construction of a stuffer box crimper by means of multiple precision ground plates held together in side-by-side contacting relationship and dowel-aligned so that the crimper rolls and other movable components are readily and properly aligned.

10 Claims, 6 Drawing Figures

DOWEL-ALIGNED MULTIPLE PLATE STUFFER BOX CRIMPER CONSTRUCTION FOR FILTER TOW

TECHNICAL FIELD

My invention relates to a stuffer box crimper such as for cigarette filter tow and particularly to a multiple plate construction for the stuffer box crimper by which precision alignment of the crimper rolls and scraper blades, to mention only a few of the operating elements, is more readily accomplished, and adjustment of the operating elements by an operator is simplified.

BACKGROUND ART

In the prior art the main frame supports for the crimper rolls have been variously formed from cast constructions, bolted plates, and welded plates with the bores for the rotative support of the crimper rolls being initially rough bored prior to assembly and then finished bored after assembly of the plates. Since at least one of the crimper rolls is adjustably movable with respect to the other of the crimper rolls, the support for the movable crimper roll has to be mounted in such manner that the axes of both crimper rolls are aligned and parallel with each other at all positions of the movable crimper roll with respect to the other crimper roll. Sufficient space is often left in the design of the framework to enable an operator to manually position feeler gauges within the main framework of the stuffer box crimper in order to align and properly space the upper and lower scraper blades with respect to the upper and lower crimper rolls. As is well known to those skilled in the art, this type of adjustment requires a skilled operator, and the adjustment of one stuffer box crimper with respect to other stuffer box crimpers can vary with the consequence that there will be variability in tows passing through the various stuffer box crimpers. In other words, it is highly desirable that filter tows be uniform as possible from one stuffer box crimper to the next.

In some stuffer box crimper constructions, the crimper roll shafts and the locations where the shafts are supported for rotation are actually too remote from the crimper rolls. As a consequence, when a load is placed upon the upper crimper roll, for example, as from a diaphragm-actuated piston, the shafts for the upper and lower crimper rolls and the crimper rolls will deflect to such extent as to cause an undesirable change in the gap between the crimper rolls and the tips of the scraper blades. Filaments will become undesirably trapped in such gap, resulting in damaged tow, i.e., cut filaments, etc. It is, therefore, highly desirable that the supports for the crimper roll shafts be placed as close as possible to the crimper rolls to minimize any undesirable deflection.

It is also highly desirable that the stuffer box crimpers be easily replicated with the same tolerances, and that each such crimper be sufficiently rigid in construction to maintain such tolerances.

All such requirements as discussed above, as well as other requirements not discussed but known to those skilled in the art, serve to produce a more uniformly crimped product. Also as will be appreciated by those skilled in the art, all improvement in uniformity may not necessarily be evident in cigarette filter rod properties, for example, because the filter rod making processes may introduce some variation, even if the filter tow is perfectly uniform. This inherent process variation has been observed to increase with lower total denier filter tows.

DISCLOSURE OF THE INVENTION

In accordance with the present invention, therefore, I provide a stuffer box crimper for crimping filament tow and including upper and lower crimper rolls each including a shaft extending from each side of the crimper roll along the axis thereof, upper and lower scraper blades spaced apart from each other and defining therebetween a crimping chamber, and a clappper mounted for movement within the crimping chamber. The stuffer crimper comprises (a) a main frame assembly forming a support for the stuffer box crimper and defining a pair of journalled seats for the shaft of the lower crimper roll, (b) a sub-frame assembly movably mounted within the main frame assembly and defining a pair of journalled seats for the shaft of the upper crimper roll, and (c) a crimper chamber assembly mounted for movement into and out of the main frame assembly and including the aforementioned upper and lower scraper blades and clapper. Each of the main frame, sub-frame, and crimper chamber assemblies is comprised of multiple precision ground plates held together in side-by-side contacting relationship. Each plate has plate-contacting side face surface area(s) sufficient in extent to stabilize the plate in a non-rocking relation to the plate-contacting side face surface area(s) of an adjacent plate with which it is in contact and defines a predetermined number of bore holes formed through the plate and spaced in a predetermined manner. The assemblies have a corresponding number of dowel pins for close sliding relationship with the bore holes for precisely orienting and aligning the multiple precision ground plates with respect to each other, and include bolt members for holding the plates of each of the assemblies in such precise alignment. The multiple plates of the main frame assembly and of the sub-frame assembly and of the main frame assembly and of the crimper chamber assembly define cooperating guide means therebetween for enabling (1) the sub-frame assembly and its supported upper crimper roll to be slidably moved in a vertical plane at right angles to the axis of the lower crimper roll toward and away from the lower crimper roll for adjustment of the nip between the upper and lower crimper rolls, and (2) the crimper chamber assembly to be aligned within the main frame assembly.

The dowel pins for the main frame assembly and the sub-frame assembly are hollow and the bolt members for these assemblies extend through the hollow dowel pins.

The plate-contacting side frame surface areas of each of the multiple plates may be flat and lie in a plane parallel to the general plane of each plate.

The outer plates of the main frame assembly define therebetween a chamber for receiving the crimper chamber assembly.

The multiple plates of the main frame assembly include an upper and lower adjustment means adapted to engage respectively upper and lower surfaces of one of the multiple plates of the crimper chamber assembly for adjusting the vertical relationship of the crimper chamber assembly with respect to the crimper rolls and to the nip between the upper and lower crimper rolls.

The stuffer box crimper also includes a pair of cheekplate assemblies each having a cheekplate for engagement against the side faces on one of the sides of the upper and lower crimper rolls and bridging across the nip between the upper and lower crimper rolls. The outer plates of the crimper chamber assembly each define a chamber for receiving and supporting therewithin one of the cheekplate assemblies.

The upper and lower crimper rolls are each formed with their respective shafts as a single unit. Each shaft has a diameter smaller than the diameter of the crimper roll and includes a pair of annular thrust bearing seals each encircling the shaft on one of the sides of a crimper roll. The main frame assembly includes annular grooves formed in the multiple flat plates adjacent each side of the crimper rolls for receiving in seating relationship one of the annular thrust bearing seals. The annular grooves and the annular thrust bearing seals are thereby adapted to axially position and align the crimper rolls respectively within the main frame assembly and the sub-frame assembly.

Each cheekplate assembly includes a cylindrical side button arrangement for receiving in seated relationship at one end thereof a portion of the cheekplate. The cylindrical side button arrangement has an intermediate portion that is reduced in diameter and is provided with a straight knurled surface. The stuffer box crimper includes a reciprocably movable push rod having at one end an arrangement for engaging the straight knurled surface of the cylindrical side button to rotate in increments the cylindrical side button and the cheekplate seated in the cylindrical side button. The stuffer box crimper also includes an arrangement for reciprocably moving the push rod.

Each single unit crimper roll and shaft defines a passageway therethrough along the axis of the crimper roll and shafts adapted to receive coolant or a heated fluid to circulate through each of the passageways.

An annular needle bearing is provided for each journalled seat for rotative support of each of the crimper roll shafts.

BRIEF DESCRIPTION OF THE DRAWINGS

The details of my invention will be described in connection with the accompanying drawings, in which.

BEST MODE FOR CARRYING OUT THE INVENTION

Figure 1:
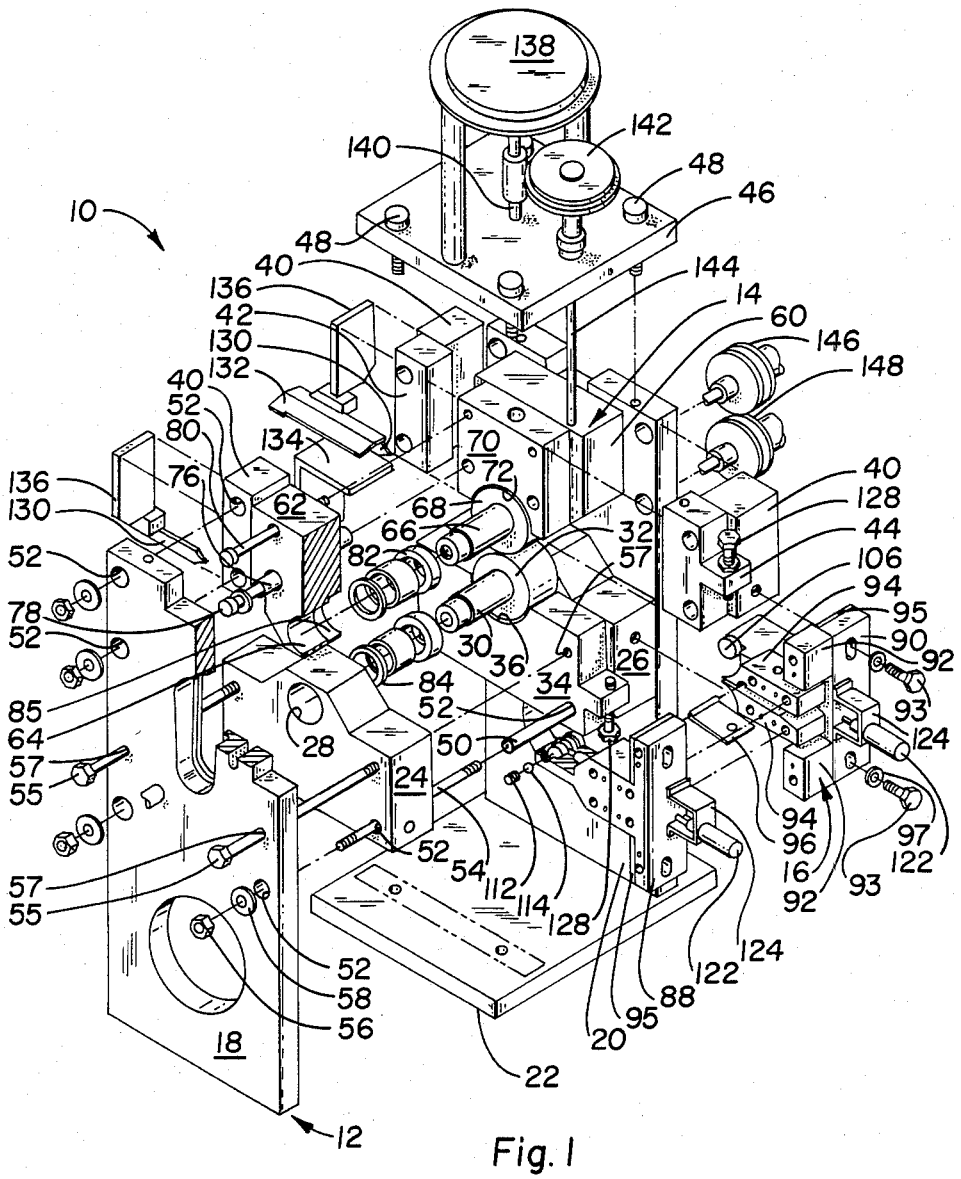
FIG. 1 is a partially exploded isometric view of a novel construction of a stuffer box crimper with some of the parts removed in part or in whole in order to illustrate the invention.

In reference to the drawings, the stuffer box crimper 10 serves to crimp a continuous filament tow such as may be used in filter rods for subsequent cutting into filter elements for cigarettes. The stuffer box crimper has a main frame assembly 12, a sub-frame assembly 14, and a crimper chamber assembly 16. Each of the main frame, sub-frame, and crimper chamber assemblies is comprised of multiple precision ground plates held together in side-by-side contacting relationship. Each plate of the multiple plate construction has at least sufficient plate-contacting surface areas on each of its two major side surfaces to promote and provide a precise, parallel relationship of that plate to the general plate of an adjacent plate. In other words, each major side surface of a plate, as contrasted with its narrower end surfaces, is provided with a plate-contacting surface area or areas sufficient in extent to stabilize that plate in a non-rocking, parallel relation to the plate-contacting surface area or areas of an adjacent plate with which it is in contact. Each of the plate-contacting surface areas shown in this invention is shown flat, which is the simplest construction. The flat plate-contacting surface area could represent a smaller area of the plate than what is shown herein, so long as sufficient area is provided to assure that one plate will not rock with respect to another plate, as mentioned above. Other side surface configurations more difficult to machine may also be used so long as each general plane of one plate is maintained parallel to the general plane of adjacent plate(s).

(A) Main Frame Assembly

The main frame assembly 12 of the stuffer box crimper 10 forms a support for the stuffer box crimper and is comprised of a series of multiple plates with each plate having preferably side surfaces that are flat and parallel with respect to the side surfaces of adjacent plates.

The main frame assembly 12 includes a left hand side or outer frame plate 18 and a right hand side or outer frame plate 20 (as viewed from FIG. 1, for instance), which are positioned on and suitably secured to a bottom plate 22 as by a threaded socket and screw arrangement (not shown). Inwardly of the two outer frame plates 18,20 is a pair of lower roll bearing block plates 24,26 which defines cylindrical journalled seats 28 for the shaft 30 of the lower crimper roll 32, and a lower roll spacer plate 34 which defines a semi-circular opening 36 for receiving a portion of the lower crimper roll 32.

Figure 2:
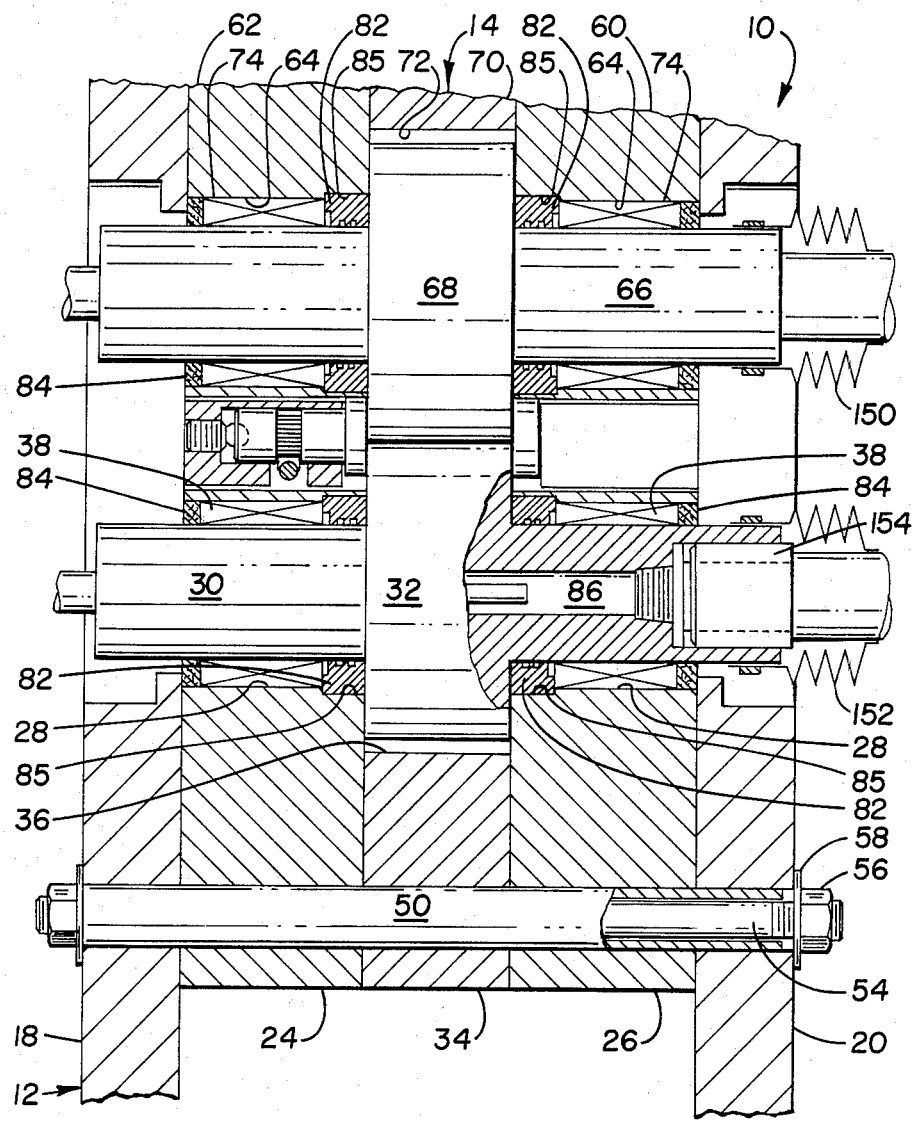
FIG. 2 is a fractional end elevational view in cross-section of the novel construction of a stuffer box crimper and in particular illustrating the crimper rolls and the doweled multiplate construction.

As may be particularly observed from FIG. 2, the lower crimper roll shaft 30 is rotatably supported by annular needle bearings 38 within the cylindrical journalled seats 28. Each lower roll bearing block plate 24,26, therefore, is positioned between one of the outer frame plates 18,20 and the lower roll spacer plate 34. There are two outer spacer block plates 40 adjacent each of the two outer frame plates 18,20; an inner spacer block plate 42 between two of the outer spacer block plates 40 at the tow entrance side of the stuffer box crimper; and an inner spacer block plate 44 between two of the outer spacer block plates 40 at the tow exit side of the stuffer box crimper. One of the outer spacer block plates 40 at the tow exit side of the stuffer box crimper is not shown in FIG. 1 because of the manner in which the exploded view had to be shown.

The plates discussed thus far of the main frame assembly 12 are surmounted by a top plate 46, which is suitably secured to the two outer spacer block plates 18,20 as by bolts 48, and are precision aligned for holding together by dowel pins 50 extending through bores 52 formed at right angles through the faces of the plates. The dowel pins 50 have a predetermined outer diameter for sliding fit within the bores 52 and are hollow for receipt therethrough of bolts 54 for holding the plates in such precise alignment. Nuts 56 along with washers 58 serve their known function in cooperation with the bolts 54. Bolts 55 extend through bores 57 to further secure the precise alignment of the multiple plates.

(B) Sub-Frame Assembly

The sub-frame assembly 14 of the stuffer box crimper 10 is movable in close sliding relation with respect to the main frame assembly 12 and may be readily removed from and repositioned in the main frame assembly when the top plate 46 is removed. The sub-frame assembly includes right and left hand (as viewed from FIGS. 1 and 2, for instance) upper roll bearing box plates 60,62 which define journalled seats 64 for the shaft 66 of the upper crimper roll 68; and an upper roll spacer plate 70, which defines a semicircular opening 72 for receipt of a portion of the upper crimper roll 68. As may be observed from FIG. 2, the upper crimper roll shaft 66 is rotatably supported by annular needle bearings 74 within the cylindrical journalled seats 64. The plates of the sub-frame assembly are also precision aligned for holding together by dowel pins 76 which are hollow for receipt therethrough of bolts 78. Other bolts 80 aid in holding the plates of the sub-frame assembly in precise alignment once the dowel pins have brought about the initial alignment.

The close sliding relationship between the sub-frame assembly and the main frame assembly is accomplished in the manner in which the plates are formed. As may be observed from FIG. 1 but particularly from FIG. 5, the three plates 60,70,62 of the sub-frame assembly are keyed in with respect to the three plates 40,42,40 of the main frame assembly at the tow entrance side of the stuffer box crimper and with respect to the three plates 40,44,40 at the tow exit side of the stuffer box crimper, and slide relative to the inner side surfaces of the outer frame plates 18,20 with the plates of the main frame assembly 12 and of the sub-frame assembly 14 being precisely aligned and keyed for sliding cooperation together. The upper crimper roll 68 and its shaft 66 are aligned and parallel with respect to the lower crimper roll 32 and its shaft 30 in all positions of the sub-frame assembly 14 within the main frame assembly 12.

(C) Crimper Rolls

As will also be observed from FIG. 2, the shafts 30,66 are relatively short with their support being provided close to the crimper roll on each side of the crimper roll. A labyrinth type thrust bearing seal 82 is interposed between each side face of the crimper rolls and the respective annular needle bearings, and an annular felt member 84 is provided for each end of the shaft contiguous to the annular needle bearings opposite from the respective thrust bearing seals.

Annular grooves 85 are formed in the multiple flat plates adjacent each side of the crimper rolls for receiving in seating relationship one of the annular thrust bearing seals 82. More specifically, the annular grooves 85 are formed in the face of each of the lower roll bearing block plates 24,26 and each of the right and left hand upper roll bearing box plates 60,62 as may be observed from FIG. 2. These annular grooves and the annular thrust bearing seals cooperate to axially position and align the respective crimper rolls within the main frame assembly and the sub-frame assembly.

The relative shortness of the shafts, which results from placement of the annular needle bearings in close proximity to the crimper rolls as well as making the shafts relatively thick, serves to minimize any possible shaft deflection and hence there will be minimal roll deflection under load, thus enabling better control over the positioning of the crimper rolls relative to each other and uniformity of adjustment relative to the scraper blade tips.

As may be further observed from FIG. 2, the integral shaft and crimper roll have a passageway 86 extending along the axis thereof which serves as a passageway for a circulating fluid for heating or cooling purposes.

(D) Crimper Chamber Assembly

The crimper chamber assembly 16 of the stuffer box crimper 10 is readily removable from and repositionable into the main frame assembly 12 at the tow exit side of the stuffer box crimper and comprises a pair of chamber side plates 88,90 and therebetween an upper and lower chamber key plates 92, upper and lower scraper blades 94 and a hinged clapper 96 pivotably hinged to the upper scraper blade. The plates are precisely aligned with respect to each other by dowel pins 98 and then bolted together by bolts 100 to hold the plates together in such alignment.

Figure 5:
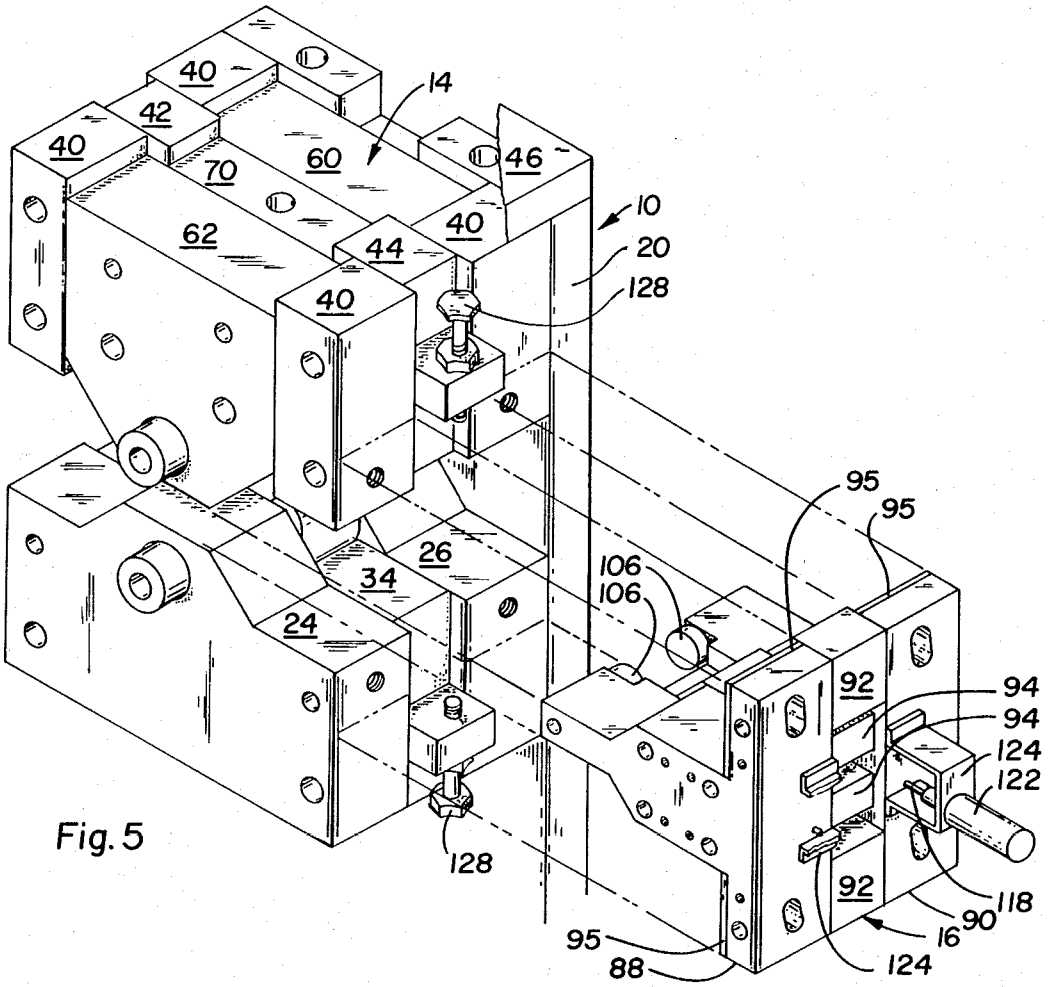
FIG. 5 is a partially exploded isometric view of the novel construction of a stuffer box crimper and illustrating the crimper chamber assembly relative to the main frame assembly and sub-frame assembly, and the slidably keyed relationship between the sub-frame assembly and the main frame assembly of the stuffer box crimper.

The chamber key plates 92 of the crimper chamber assembly 16 are designed to have a close sliding interfit with the plates of the main frame assembly 12, as may be particularly noted from FIG. 5. The chamber key plates slidingly fit between two of the outer spacer block plates 40 and between the two lower roll bearing block plates 24,26 of the main frame assembly 12 when the crimper chamber assembly is repositioned within the stuffer box crimper 10.

Figure 4:
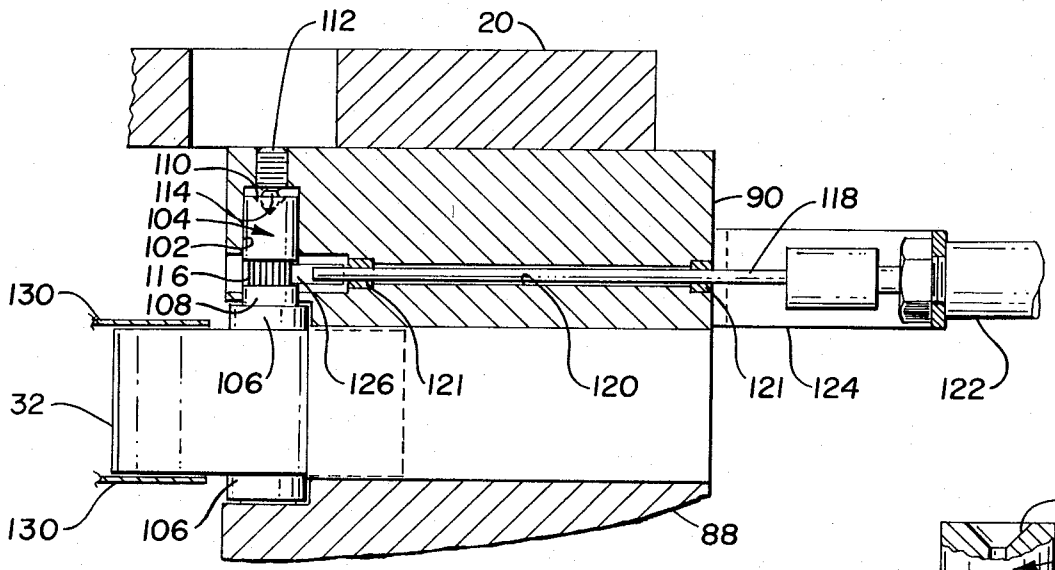
FIG. 4 is a fractional plan view in cross-section illustrating the pneumatically operated pusher rod for intermittently rotating the cheekplate relative to the crimper rolls and the cheekplate pressure adjustment arrangement.

The chamber side plates 88,90 of the crimper chamber assembly 16 each have a bifurcated portion at one end which defines therewithin a chamber 102 (FIG. 4) which is cylindrical in configuration with the axis across the bifurcated portion perpendicularly to the side faces of the chamber side plate. As may be particularly observed from FIG. 4, the cylindrical chamber extends part way through one of the bifurcated portions and all the way through the other bifurcated portion. The chamber 102 is adapted to receive therewithin and across the space between the bifurcated portions a cheekplate assembly 104.

(E) Cheekplate Assembly

Figure 4A:
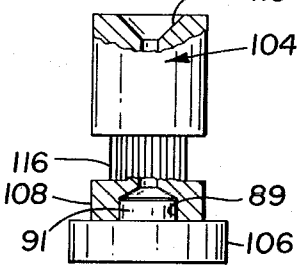
FIG. 4*a* is an enlarged fractional view of the cheekplate and chamber side button from FIG. 4.

Each cheekplate assembly 104 includes a cylindrical cheekplate 106 which may be formed, for example, from a martensitic type of steel and which serves to engage the side faces on one side of the two crimper rolls, thereby bridging the gap across the nip of the crimper rolls; and also includes a chamber side button 108. The cheekplate may also be formed from any other suitable material such as ceramic, bronze, or brass, for example. Each chamber side button is cylindrical in configuration and is adapted to slidingly and rotatively fit within the chamber 102 in one of the chamber side plates 88,90. The chamber side button may be provided with a concentric bore 89 (FIG. 4*a*) at one end and the cheekplate 106 may be provided with a reduced diameter portion or shaft 91 (FIG. 4*a*) for fitting within the concentric bore in the chamber side button and cemented in place. The opposite side of the chamber side button is provided with a cone-shaped depression 110 with which an adjustment screw 112 is designed to abut against a steel ball 114 for adjustment of the pressure of the cheekplate against the side faces of the upper and lower crimper rolls 68,32. The intermediate portion of the chamber side button is reduced in diameter, spans across the space between the bifurcated portions of the chamber side plate, and is provided with a straight knurled surface 116, with the knurls running parallel to the axis of the cylindrical side button 108.

Figure 3:
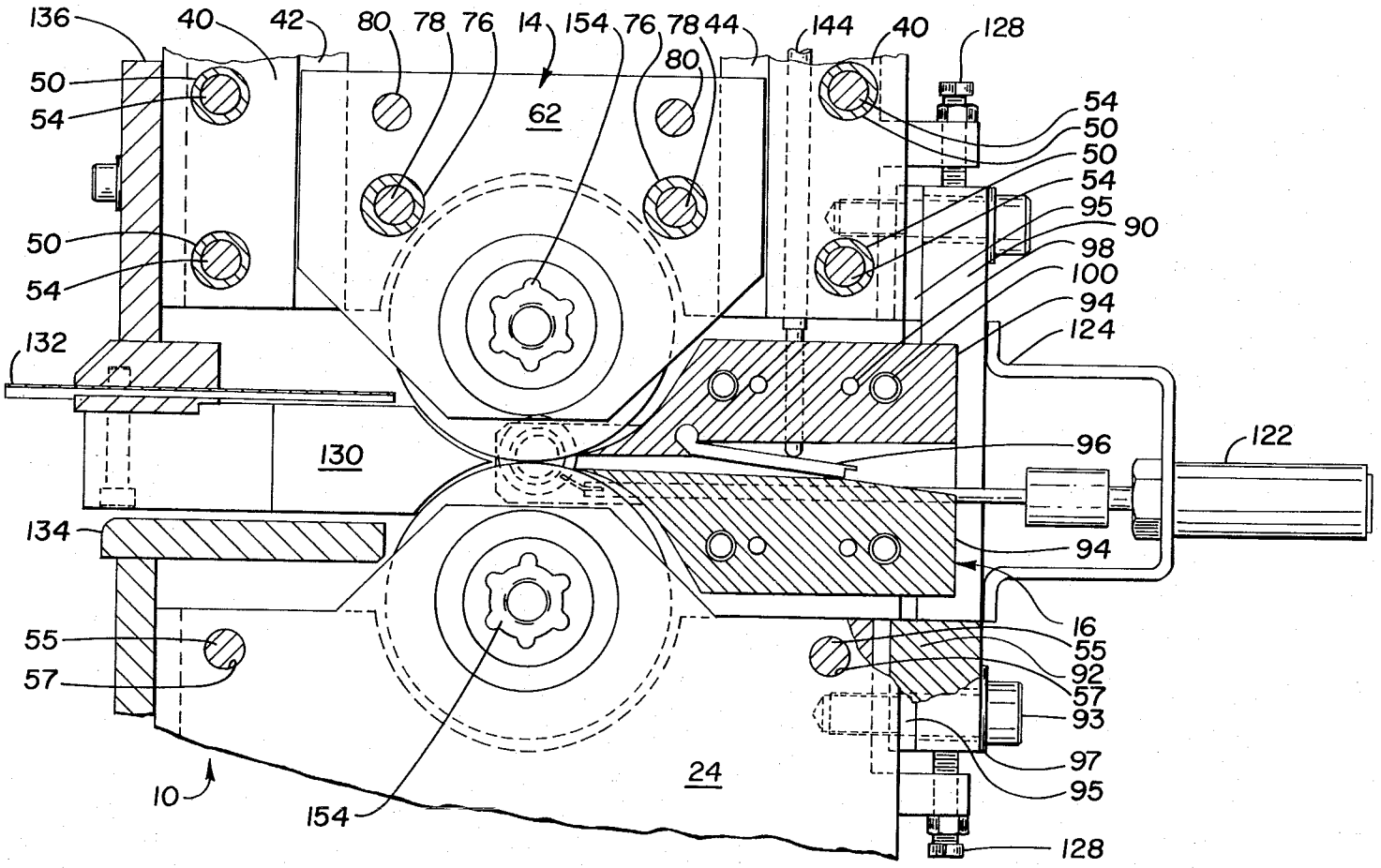
FIG. 3 is a fractional side elevational view in cross-section of the novel construction of a stuffer box crimper and illustrating the scraper blades and clapper of the crimper chamber assembly relative to the crimper rolls and the mechanism for vertically adjusting the crimper chamber assembly relative to the main frame assembly.

The cheekplate 106 through its fixed connection to the cylindrical side button is intermittently rotated by the reciprocal engagement of a pneumatically-operated push rod 118, which extends through a cylindrical passageway 120 in each of the chamber side plates 88,90 and is centered therein by bushings 121. The pneumatic cylinder is shown in part, for instance, at 122 in FIG. 4. It is also seen in FIGS. 1, 3, and 5, and is supported by a mounting bracket 124, which is suitably secured to an end face of each of the chamber side plates 88,90. The push rod 118 has at its free end a blade 126 which engages the straight knurled surface 116 upon each reciprocation of the push rod to cause rotation of the chamber side button 108 and its connected cheekplate 106.

(F) Assembly of Stuffer Box Crimper

In the assembly of the stuffer box crimper 10 in preparation for operation of the crimper, the scraper blades 94 of the crimper chamber assembly 16 are suitably adjusted relative to each other before the crimper chamber assembly 16 is positioned within the main frame assembly 12. As heretofore discussed, the upper and lower chamber key plates 92 serve to control part of the positioning of the crimper chamber assembly by centering it with respect to the main frame assembly 12 and to the sub-frame assembly 14. The vertical relationship of the crimper chamber assembly relative to the main and sub-frame assemblies is controlled by the two adjusting screws 128 threadedly supported by the inner spacer block plate 44 at the tow exit side of the crimper and by the lower roll spacer plate 34 and which abut, respectively, the top surface of the upper chamber key plate 92 and the bottom surface of the lower chamber key plate 92.

When the crimper chamber assembly is repositioned within the main frame assembly 12, properly positioned and aligned, it is then secured by bolts 93 and washers 97. The openings through which the bolts extend in the chamber side plates 88,90 are oval-shaped (Note FIGS. 1 and 5, for instance) to allow a predetermined latitude of adjustment. A pair of upper and lower shims 95 of predetermined thickness are provided between the inner faces of each chamber side plate and each outer spacer block plate 40 at the tow exit side of the crimper and each lower roll bearing block plate 24,26. The thickness of the shims serves to determine the spacing of the tips of the upper and lower scraper blades 94 with respect to the upper and lower crimper rolls. Thus, depending upon the spacing desired, thicker or thinner shims 95 may be used.

At the tow entrance side of the stuffer box crimper 10, there is a pair of tow shields 130, which serve to confine the filter tow to the desired tow path toward the crimper rolls; a drip shield 132; a lower shield 134; and a pair of tow shield mounting blocks 136 for supporting the tow shields 130.

(G) Operation

In operation of the stuffer box crimper 10, the sub-frame assembly 14 and its upper crimper roll 68 are loaded against the tow passing between the crimper rolls by means of the pneumatic diaphragm actuator 138, and the diaphragm piston rod 140 which pushes against the sub-frame assembly.

The hinged clapper 96 is urged against tow passing through the crimping chamber assembly 16 by means of a pneumatic diaphragm actuator 142 and diaphragm piston rod 144, the latter abutting against the clapper.

The drive for the upper and lower crimper rolls is not actually shown but the couplings for the drive are shown in part at 146 and 148, as in FIG. 1. Grease boot 150,152 (FIG. 2) serve to contain grease for the spline drive connection 154 (FIGS. 2 and 3) for the crimper rolls.

Suitable passageways (not shown) may be provided for lubrication of the annular needle bearings 74 and the chamber side buttons 108, as by making such passageways in the lower roll bearing plates 24,26, right hand and left hand upper roll bearing box plates 60,62 and the chamber side plates 88,90.

It will therefore be apparent from the description given that each plate in the multiple plate construction is readily replaceable with another like plate, similarly precision ground. In this manner of construction, the stuffer box crimper may be easily disassembled for cleaning, replacement of any worn parts, or inspection and then reassembled in the same precise alignment.

Assembly and disassembly of the stuffer box crimper may be accomplished by a relatively unskilled operator, if need be.

It should now be apparent, also, that alignment of the crimper rolls relative to each other and to the tow path in all planes is always assured. Adjustment of the scraper blade of the crimper chamber assembly relative to the crimper rolls may be readily accomplished by a relatively unskilled operator.

The multiple plate construction enables the support of the adjustable crimper roll and the support for the adjustable scraper blades and clapper to be slidingly interfitted in a precise, controlled manner.

It should further be apparent that since the dowel pins are designed to have a close sliding fit through bores provided in the plate and that the dowels are sufficient in number and spacing so as to orient the plates in a precise, predetermined relationship, this same precise relationship may be readily repeated, should reassembly be required following a disassembly for whatever reason.

Still further, it will be recognized that each journalled support for each shaft portion of each crimper roll is provided by one of the multiple plates, which is readily, precisely aligned.

The invention has been described in detail with particular reference to preferred embodiments thereof, but it will be understood that variations and modifications can be effected within the spirit and scope of the invention.

I claim:

1. A stuffer box crimper for crimping filament tow and including upper and lower crimper rolls each including a shaft extending from each side of the crimper roll along the axis thereof, upper and lower scraper blades spaced apart from each other and defining therebetween a crimping chamber, and a clapper mounted for movement within said crimping chamber, said stuffer box crimper comprising (a) a main frame assembly forming a support for said stuffer box crimper and defining a pair of journalled seats for the shaft of the lower crimper roll, (b) a sub-frame assembly movably mounted within said main frame assembly and defining a pair of journalled seats for the shaft of the upper crimper roll, and (c) a crimper chamber assembly mounted for movement into and out of said main frame assembly and including said upper and lower scraper blades and said clapper, each of said main frame, sub-frame and crimper chamber assemblies being comprised of multiple precision ground plates held together in side-by-side contacting relationship, each plate having plate-contacting side face surface area(s) sufficient in extent to stabilize the plate in a non-rocking relation to the plate-contacting side face surface area(s) of an adjacent plate with which it is in contact and defining a predetermined number of bore holes formed through the plate and spaced in a predetermined manner, said assemblies having a corresponding number of dowel pins for close sliding relationship with said bore holes for precisely orienting and aligning said multiple precision ground plates with respect to each other, and including bolt members for holding said plates of each said assembly in said precise alignment, and said multiple plates of said main frame assembly and of said sub-frame assembly and of said main frame assembly and of said crimper chamber assembly defining cooperating guide means therebetween for enabling (1) said sub-frame assembly and its supported upper crimper roll to be slidably moved in a vertical plane at right angles to the axis of said lower crimper roll toward and away from said lower crimper roll for adjustment of the nip between said upper and lower crimper rolls, and (2) said crimper chamber assembly to be aligned within said main frame assembly.

2. A stuffer box crimper as defined in claim 1 wherein said plate-contacting side face surface areas are flat and lie in a plane parallel to the general plane of each plate.

3. A stuffer box crimper as defined in claim 1 wherein the dowel pins for said main frame assembly and said sub-frame assembly are hollow and said bolt members extend through said hollow dowel pins.

4. A stuffer box crimper as defined in claim 1 wherein the outer plates of said main frame assembly define therebetween a chamber for receiving said crimper chamber assembly.

5. A stuffer box crimper as defined in claim 1 wherein said multiple plates of said main frame assembly include an upper and lower adjustment means adapted to engage respectively upper and lower surfaces of one of said multiple plates of said crimper chamber assembly for adjusting the vertical relationship of said crimper chamber assembly with respect to the crimper rolls and the nip between the upper and lower crimper rolls.

6. A stuffer box crimper as defined in claim 1 and comprising a pair of cheekplate assemblies each having a cheekplate for engagement against the side faces on one of the sides of the upper and lower crimper rolls and bridging across the nip between said upper and lower crimper rolls, and wherein the outer plates of said crimper chamber assembly each define a chamber for receiving and supporting therewithin one of said cheekplate assemblies.

7. A stuffer box crimper as defined in claim 6 wherein each said cheekplate assembly includes, in addition to said cheekplate, a cylindrical side button means for receiving in seated relationship at one end thereof a portion of said cheekplate, said cylindrical side button means having an intermediate portion that is reduced in diameter and is provided with a straight knurled surface, and said stuffer box crimper including a reciprocably movable push rod having at one end means for engaging the straight knurled surface of said cylindrical side button to rotate in increments said cylindrical side button and said cheekplate seated in said cylindrical side button, and also including means for reciprocably moving said push rod.

8. A stuffer box crimper as defined in claim 1 wherein said upper and lower crimper rolls are each formed with their respective shafts as a single unit, each shaft having a diameter smaller than the diameter of the crimper roll and including a pair of annular thrust bearing seals each encircling the shaft on one of the sides of a crimper roll, said main frame assembly and said sub-frame assembly including annular grooves formed in the multiple plates adjacent each side of the crimper rolls for receiving in seating relationship one of said annular thrust bearing seals, said annular grooves and said annular thrust bearing seals thereby being adapted to axially position and align said crimper rolls respectively within said main frame assembly and said sub-frame assembly.

9. A stuffer box crimper as defined in claim 1 wherein said upper and lower crimper rolls are each formed with their respective shafts as a single unit and each said single unit defines a passageway therethrough along the axis of the crimper roll and shafts adapted to receive coolant or a heated fluid to circulate through each said passageway.

10. A stuffer box crimper as defined in claim 1 wherein an annular needle bearing is provided for each journalled seat for rotative support of each of said crimper roll shafts.

* * * * *